US006047896A

United States Patent [19]

Moroi et al.

[11] Patent Number: 6,047,896

[45] Date of Patent: Apr. 11, 2000

[54] VISCOUS FLUID TYPE HEAT GENERATING APPARATUS

[75] Inventors: Takahiro Moroi; Hidefumi Mori; Yasuhiro Fujiwara; Tatsuyuki Hoshino, all of Kariya, Japan

[73] Assignee: Kabushiki Kaisha Toyoda Jidoshokki Seisakusho, Aichi-ken, Japan

[21] Appl. No.: 09/262,723

[22] Filed: Mar. 4, 1999

[30] Foreign Application Priority Data

Mar. 6, 1998 [JP] Japan ..... 10-055286

[51] Int. Cl.[7] ..... B60H 1/02

[52] U.S. Cl. ..... 237/12.3 R; 122/26; 126/247

[58] Field of Search ..... 237/12.3 R, 12.3 B; 122/26, 247; 123/142.5 R, 142.1 R

[56] References Cited

U.S. PATENT DOCUMENTS 4,285,329 8/1981 Moline ..... 126/247
4,312,322 1/1982 Freihage ..... 126/247
4,974,778 12/1990 Bertling ..... 126/247
5,573,184 11/1996 Martin ..... 126/247

*Primary Examiner*—Harold Joyce
*Assistant Examiner*—Derek S. Boles
*Attorney, Agent, or Firm*—Morgan & Finnegan, L.L.P.

[57] ABSTRACT

A viscous fluid type heating apparatus capable of achieving both reliable prevention of deterioration in the heat-generating performance of a viscous fluid and reliable prevention of leakage of the viscous fluid from the apparatus, and having a heat generating chamber provided with a first and a second storing region for storing a silicone oil to avoid an application of a shearing action from a rotor element to the viscous fluid and a heat generating gap. The silicone oil is held in the heat generating chamber so that it is able to flow between the heat generating gap and the first storing region which is directly affected by a thermal condition in the heat generating gap. The second storing region is substantially separated from the first storing region and is not directly affected by the thermal condition in the heat generating gap. The flow of the silicone oil between the first and second storing regions is adjustable by a movable element.

13 Claims, 4 Drawing Sheets

VISCOUS FLUID TYPE HEAT GENERATING APPARATUS

BACKGROUND OF THE INVENTION

1. Field of the Invention

The present invention relates generally to a viscous fluid type heat generating apparatus generating heat by applying a shearing action to a viscous fluid, and transmitting the heat from the viscous fluid to a heat exchanging fluid flowing through a heat receiving chamber in order to carry the heat to a desired heated area, such as a passenger compartment of a vehicle. Thus, the heat is carried by the heat exchanging fluid to the desired heated area. More particularly, the present invention relates to a viscous fluid type heat generating apparatus provided with a means for ensuring a long operation life of a viscous fluid which is apt to be degraded thermally and physically during the operation of the heat generating apparatus.

2. Description of the Related Art

A viscous fluid type heat generating apparatus intended for use in a vehicle climate controlling system is disclosed in German Laid-Open Patent Publication No. 3832966, i.e., DE-OS-3832966, of which the corresponding U.S. case was issued as U.S. Pat. No. 4,974,778. The viscous fluid type heat generating apparatus of DE-OS '966 and U.S. Pat. No. '778 has a housing in which a heat generating chamber and a heat receiving chamber, working as a water jacket and arranged adjacent to the heat generating chamber to pass a heat exchanging fluid therethrough, are formed. A drive shaft is supported to rotate via bearing devices and shaft seating devices in the housing, and a pulley element is fixedly mounted on a front end part of the drive shaft to be rotationally driven through a belt by a vehicle engine. A rotor element is formed integrally with a rear end part of the drive shaft to be able to rotate in the heat generating chamber. A viscous fluid, such as silicone oil, is filled in a gap between the wall surface of the heat generating chamber and the outer surface of the rotor element. The rotor element generates heat in the viscous fluid when rotated. The heat generating chamber has a storing region communicating with the gap by means of a withdrawing passage and a supply passage. The storing region of the heat generating chamber is provided for storing a given part of the viscous fluid in order to prevent exertion of the shearing action of the rotor element on the stored viscous fluid. The withdrawing passage is formed so as to permit the viscous fluid to positively move from the heat generating chamber into the storing region during the rotation of the rotor element, and the supply passage can be opened and closed by a valve means including a bimetal strip to supply the viscous fluid from the storing region to the gap of the heat generating chamber when it opens.

In the described viscous fluid type heat generating apparatus as incorporated into a vehicle heating system, the rotor element rotates in the heat generating chamber when the drive shaft is driven by the vehicle engine, and the viscous fluid is subjected to a shearing action within the gap between the wall surface of the heat generating chamber and the outer surface of the rotor element to generate heat. The heat thus generated is transmitted to cooling water flowing through the heat receiving chamber by heat exchange, and the cooling water thus heated is supplied through a heating circuit to heat a passenger compartment or the like.

The viscous fluid is withdrawn continuously from the gap through the withdrawing passage into the storing region while the rotor element is in rotation. If the valve means placed in the supply passage is open, the viscous fluid can flow from the storing region into the gap. If the valve means is closed, the viscous fluid cannot flow from the storing region into the gap and, consequently, the viscous fluid is only withdrawn from the gap into the storing region and accordingly, heat generation in the gap is suppressed. Therefore, this viscous fluid type heat generating apparatus can stop heat generation even if the rotation of the drive shaft is not interrupted by operating a solenoid clutch or the like and can prevent the heat generating performance of the viscous fluid from being thermally degraded.

Nevertheless, it is difficult to achieve both more reliable prevention of degradation of the viscous fluid by the thermal and mechanical causes and more reliable prevention of leakage of the viscous fluid from the interior of the apparatus in the prior art viscous fluid type heat generating apparatus of U.S. Pat. No. '778. More specifically, in the prior art viscous fluid type heat generating apparatus, the heat generating chamber has, in addition to the heat-generating gap, the storing region formed to prevent the viscous fluid from being subjected to the shearing action by the rotor element when the fluid is held in the storing region, and the viscous fluid can flow through the storing region and the gap in a circulatory manner. Thus, the shearing of only a particular portion of the viscous fluid does not occur and therefore, the degradation of the heat-generating performance of the viscous fluid due to the thermal and mechanical causes can be avoided.

Nevertheless, in the described viscous fluid type heat generating apparatus of the prior art a relatively large amount of the viscous fluid needs to be stored in the storing region to ensure more reliable prevention of the degradation of the heat-generating performance of the viscous fluid. Thus, if an amount of the viscous fluid stored in the storing region of the heat generating chamber increases, the heat generating chamber is occupied by a large amount of viscous fluid and, accordingly, an amount of compressed gas such as air which remains within the heat generating chamber is reduced. Since the viscous fluid flows between the storing region and the gap, the storing region is directly subjected to the thermal influence from the heat-generating gap. Accordingly, thermal expansion of the large amount of viscous fluid occurs in the gap and the storing region of the heat generating chamber. Hence, the pressure in the heat generating chamber is liable to rise and it is possible that the viscous fluid may leak from the heat generating chamber even if the same chamber is hermetically sealed by shaft sealing devices.

SUMMARY OF THE INVENTION

An object of the present invention is to provide a viscous fluid type heat generating apparatus capable of ensuring a more reliable prevention of degradation in the heat-generating performance of the viscous fluid and a more reliable prevention of leakage of the viscous fluid from the heat generating chamber of the apparatus.

In accordance with the present invention, there is provided a viscous fluid type heat generating apparatus, which comprises:

- a housing internally defining a heat generating chamber enclosed by a wall surface thereof, and a heat receiving chamber arranged adjacent to the heat generating chamber and permitting a heat exchanging fluid to flow therethrough;
- a drive shaft rotatably supported by a bearing means and a shaft sealing means housed in the housing;

a rotor element arranged in the heat generating chamber to be driven for rotation about an axis thereof by the drive shaft and having an outer face; and a viscous fluid held in a fluid-holding gap defined between the wall surface of the heat generating chamber and the outer face of the rotor element to generate heat in response to an application of a shearing action thereto by the rotor element;

wherein the heat generating chamber defines, in addition to the fluid-holding gap, a storing chamber for storing the viscous fluid to avoid application of the shearing action from the rotor element to the viscous fluid, the storing chamber including a first storing region arranged to be directly affected by a thermal condition of the fluid-holding gap and allowing the viscous fluid to flow between the fluid-holding gap and the first storing region, and a second storing region substantially separated from the first storing region and arranged not to be directly affected by the thermal condition of the fluid-holding gap; and wherein the viscous fluid type heat generating apparatus further comprises means for adjusting the flow of the viscous fluid between the first and second storing regions of the storing chamber.

In the above-mentioned viscous fluid type heat generating apparatus, the storing chamber which can store the viscous fluid to avoid the application of the shearing action from the rotor element to the viscous fluid is arranged to have the first and the second storing regions and formed in the heat generating chamber which also forms the fluid-holding gap. The viscous fluid is able to flow between the first storing region and the fluid-holding gap, and accordingly, the shearing action is not applied to only a particular portion of the viscous fluid when a relatively large amount of the viscous fluid is stored in the first storing region and the possibility of deterioration in the heat-generating performance of the viscous fluid by a thermal and mechanical causes can be surely avoided.

Further, the relatively large amount of viscous fluid stored in the first storing region of the storing chamber can be reduced as required by allowing the viscous fluid to flow from the first storing region into the second storing region which is substantially separated from the first storing region.

It should be noted that since, the amount of viscous fluid stored in the first storing region may be adjusted by adjustably changing the ratio of volume between the first and second storing regions, the first storing region is directly affected by the thermal condition in the fluid-holding gap because the viscous fluid is able to flow between the first storing region and the fluid-holding gap. However, the second storing region is not directly affected by any thermal influence from the fluid-holding gap. Therefore, the viscous fluid of a relatively high temperature flowing from the first storing region into the second storing region can be surely cooled without being subject to the shearing action within the second storing region. Therefore, the thermal expansion of only a relatively small amount of viscous fluid occurs in the heat generating gap and the first storing region in the heat generating chamber, and the contraction of the viscous fluid occurs in the second storing region. Accordingly, an increase in the internal pressure of the heat generating chamber is small, and leakage of the viscous fluid from the heat generating chamber toward the exterior of the viscous fluid type heat generating apparatus via the shaft sealing devices can be surely prevented.

Thus, the viscous fluid type heat generating apparatus of the present invention is capable of achieving both reliable prevention of degradation in the heat generating performance of the viscous fluid and reliable prevention of leakage of the viscous fluid from the apparatus.

In the viscous fluid type heat generating apparatus of the present invention, the viscous fluid flows constantly between the fluid-holding gap and the first storing region during the rotation of the drive shaft and the ability of flow of the viscous fluid may be adjustably changed by adjusting the amount of viscous fluid flowing between the first and the second storing regions. Accordingly, when a viscous fluid having a high viscosity is used to increase the maximum amount of heat generated by every one rotation of the drive shaft, the viscous fluid can easily and smoothly flow between the fluid-holding gap and the first storing region and between the first and the second storing region. Thus, it is possible to achieve both the reliable prevention of degradation in the heat generating performance of the viscous fluid and the reliable prevention of leakage of the viscous fluid even if the viscous fluid is a high viscous fluid.

The rotor element may have a base portion mounted on the drive shaft, and a tubular portion extending axially or at an inclination to an axial direction from the base portion and having an outer face defining the fluid-holding gap. The face of the tubular portion of the rotor element defines an annular or a tapered fluid-holding gap by cooperating with the wall surface of the heat generating chamber.

The viscous fluid type heat generating apparatus can be formed in a small structure to facilitate mounting the same in a vehicle or the like. The first storing region may be formed inside the tubular portion of the rotor element so as to have opening formed in the outer face of the tubular portion of the rotor element. The viscous fluid can be supplied from the first storing region through an end part of the tubular portion into the annular or tapered gap by centrifugal force. The viscous fluid contained in the annular or tapered gap is withdrawn into the first storing region by a pressure exerted thereon by the viscous fluid supplied from the first storing region and the thermal expansion thereof. The second storing region may be formed outside the tubular portion of the rotor element. The flow rate of the viscous fluid flowing between the first and the second storing regions can be adjusted by means of a movable element which can be moved toward and away from the rotor element.

Preferably, the movable element has a radially extending end surface portion, the rotor element has an outer end surface confronting the end surface portion of the movable element, and the end surface portion of the movable element and the outer end surface of the rotor element define a disk-shaped fluid-holding gap. When the disk-shaped fluid-holding gap is formed between the end surface portion of the movable element and the outer end surface of the rotor element in addition to the above-mentioned annular or tapered gap, heat can be generated at an increased heat generating rate by the shearing action applied from the rotating rotor element to the viscous fluid held in both disk-shaped fluid-holding gap and the annular or tapered gap. The heat generating rate can be adjusted through the adjustment of the width of the disk-shaped gap by the axial movement of the movable element.

Preferably, the outer end surface is formed in the base part of the rotor element, and a connecting hole is extended through the tubular portion and the base portion of the rotor element. The connecting hole of the tubular portion facilitates the flow of the viscous fluid between the fluid-holding gap and the first storing region, and the connecting hole of the base portion facilitates the flow of the viscous fluid between the first and the second storing regions.

The movable element may be moved by the agency of the variation of the temperature of the viscous fluid, the agency of the variation of the temperature of the heat exchanging fluid or the variation of rotating speed. A solenoid or a bimetal strip may be employed to move the movable element by the agency of the variation of the temperature of the viscous fluid or the heat exchanging fluid. A solenoid may be incorporated into the apparatus to move the movable element by the agency of the variation of rotating speed. When the movable element is moved by the agency of the variation of the temperature of the viscous fluid, it is desirable to use the thermal expansion of the viscous fluid in the heat generating chamber, particularly in the first storing region. Since the movable element can thus be moved by the increase of the pressure of the viscous fluid resulting from the thermal expansion of the viscous fluid, the rotor element moves automatically when the viscous fluid is heated to a high temperature by the heat generated in the viscous fluid by the continuous operation of the viscous fluid type heat generating apparatus and hence the viscous fluid type heat generating apparatus can be formed in a simple structure.

Preferably, the movable element is moved by a solenoid. When a solenoid is employed for moving the movable element, the viscous fluid can be supplied by pressure into the gap by properly controlling the solenoid by an external controller and heat generation in the viscous fluid can properly be controlled.

Preferably, the movable element is supported for rotation such that the rotation of the movable element relative to the rotor element can be changed. Heat is generated at a high heat generating rate by the end surface portion of the movable element and the outer end surface of the rotor element when the movable element rotates at a high rotating speed relative to the rotor element, and at a low heat generating rate by the same when the movable element rotates at a low rotating speed relative to the rotor element. Thus, the heat generating rate of the viscous fluid type heat generating apparatus can be adjusted.

Preferably, the movable element is axially and constantly urged by an urging means so that the end surface portion of the movable element approaches the outer end surface of the rotor element. When the movable element is thus urged by the urging means such as a spring element, it is easy to secure a high heat generating rate at the start of the viscous fluid type heat generating apparatus.

BRIEF DESCRIPTION OF THE DRAWINGS

The above and other objects, features and advantages of the present invention will be made more apparent from the ensuing description of the preferred embodiments thereof with reference to the accompanying drawings wherein.

DESCRIPTION OF THE PREFERRED EMBODIMENTS

First Embodiment

Figure 1:
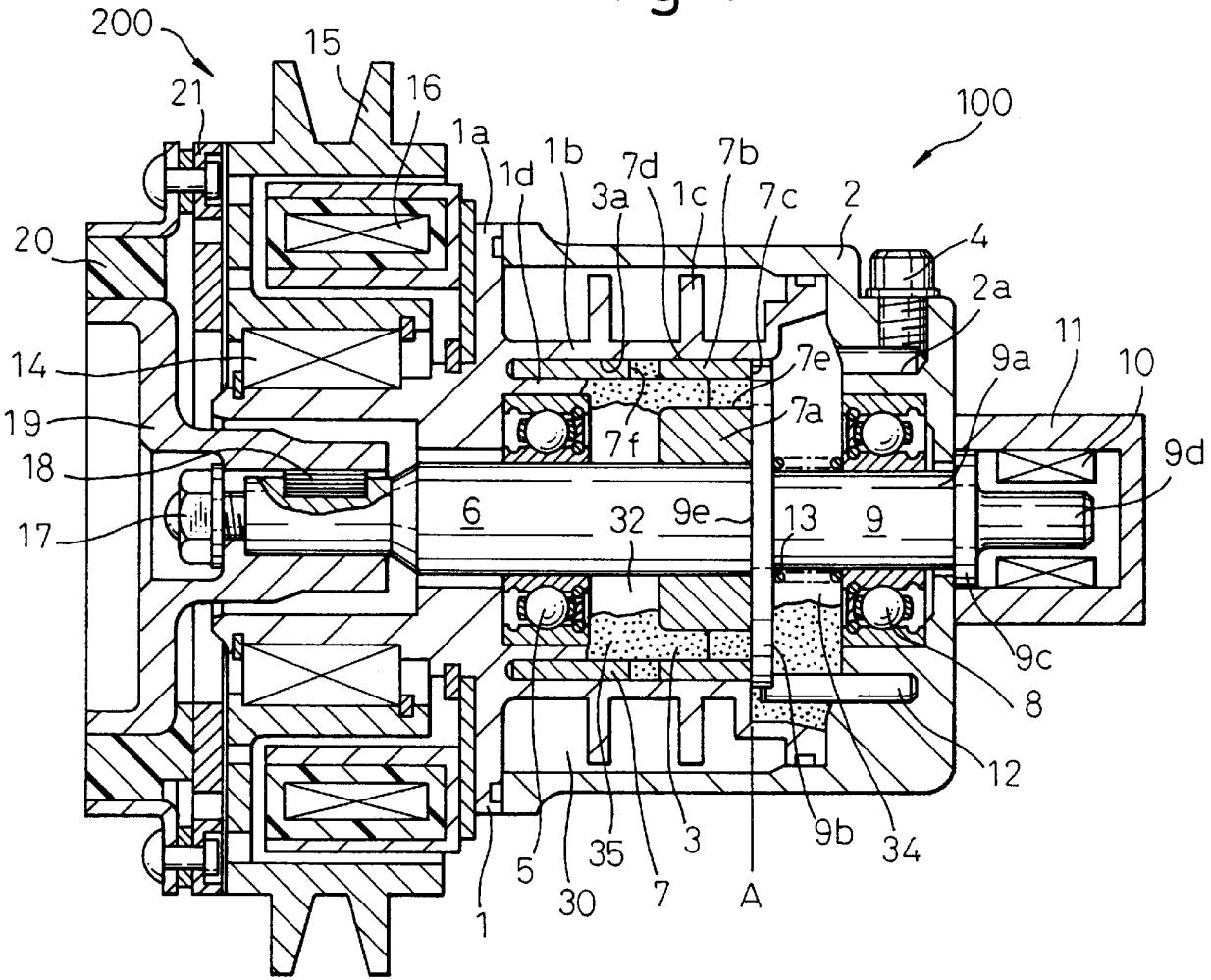
FIG. 1 is a longitudinal sectional view of a viscous fluid type heat generating apparatus according to a first embodiment of the present invention in a state before a movable element is shifted.
Figure 2:
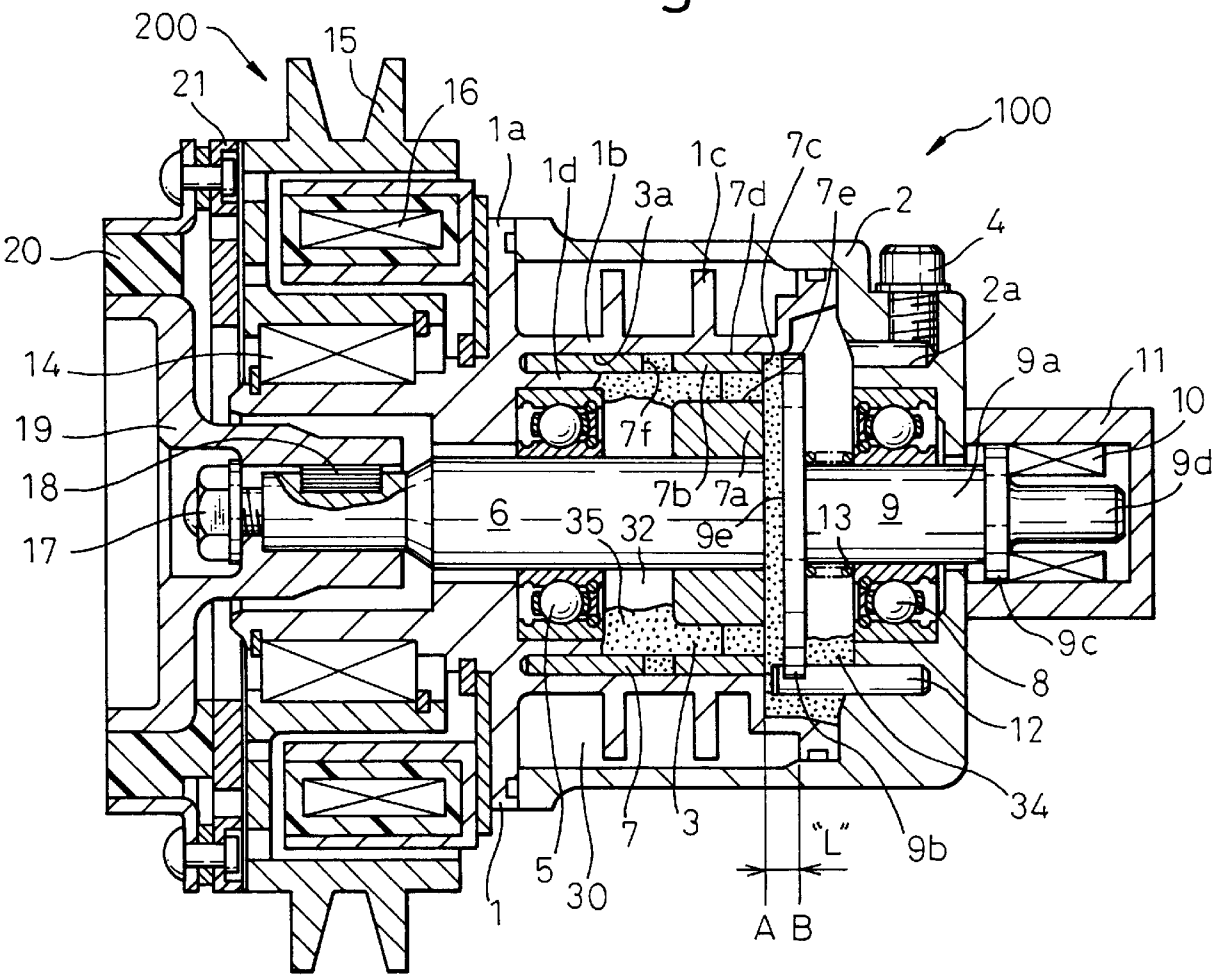
FIG. 2 is a longitudinal sectional view of the viscous fluid type heat generating apparatus of the first embodiment in a state after the movable element has been shifted.

Referring to FIGS. 1 and 2, a viscous fluid type heat generating apparatus 100 of the first embodiment of the present invention has a front housing 1 provided with a flange portion 1*a*, and a tubular portion 1*b* extending axially rearward from the flange portion 1*a* and having a cylindrical inner circumference 3*a*. A cup-shaped rear housing 2 is connected and secured to the flange portion 1*a* and the tubular portion 1*b*, and O-rings are interposed between the flange portion 1*a* and the rear housing 2 and between the tubular portion 1*b* and the rear housing 2. The inner circumference of the tubular portion 1*b* and the rear housing 3 define a sealed heat generating chamber 3. The rear surface of the flange portion 1*a*, the outer circumference of the tubular portion 1*b* and the rear housing 2 define a heat receiving chamber 30, i.e., a water jacket. The rear housing 2 is provided with a supply passage 2*a* to supply silicone oil 35, i.e., a viscous fluid, into the heat generating chamber 3. The supply passage 2*a* is closed by a screw bolt 4. The viscous fluid type heat generating apparatus uses the silicone oil 35 having a relatively high viscosity. The heat receiving chamber 30 is connected through an outlet port, not shown, and an inlet port, not shown, to an external heating system through which cooling water is circulated. The tubular portion 1*b* is provided on its outer circumference with a plurality of radial fins 1*c*. The edges of the fins 1*c* are spaced from the inner circumference of the rear housing 2.

The front housing 1 has a cylindrical inner boss 1*d* extending coaxially with the tubular portion 1*b* on the inner side of the same portion 1*b*. A bearing device 5 is provided on one end thereof on the side of the heat generating chamber 3 with a shaft seal and is fitted in the boss 1*d* to support a drive shaft 6 for rotation. A rotor element 7 capable of rotating in the heat generating chamber 3 is mounted on a rear portion of the drive shaft 6 by press-fitting. The rotor element 7 has a base portion 7*a* and a tubular portion 7*b* extending axially forward from the base portion 7*a*. The base portion 7*a* has a rear, outer end surface 7*c*. The tubular portion 7*b* has a cylindrical outer face 7*d* facing the inner circumference 3*a* of the heat generating chamber 3 so as to form an annular gap in which heat is generated by applying a shearing action from the rotor element 7 to the silicone oil 35 held in the annular gap.

A first storing region 32 extends inside the tubular portion 7*b* to store the silicone oil 35. The first storing region 32 is provided so that the application of the shearing action from the rotor element 7 to the silicone oil 35 stored therein can be prevented.

A second storing region 34 extends behind the heat generating chamber 3 and outside the tubular portion 7*b* of the rotor element 7 to store the silicone oil 35. The second storing region 34 is provided so that the application of the shearing action from the rotor element 7 to the silicone oil 35 stored therein can be prevented.

The base portion 7*a* of the rotor element 7 is provided with a plurality of axial connecting holes 7*e* formed therein to provide a fluid communication between the first and second storing chambers 32 and 34 as required. The tubular portion 7*b* is provided a plurality of radial connecting holes 7*f* formed therein to provide a fluid communication between the first storing chamber 32 and the annular gap to generate heat.

A bearing 8 having a shaft seal member on one end thereof on the side of the heat generating chamber 3 is housed in the rear housing 2 to rotatably support a movable element 9 which is arranged to be coaxial with the drive shaft 6 on the rear side of the drive shaft 6. The movable element 9 has a shaft portion 9*a* supported in the bearing 8, a first flange 9*b* formed at the front end of the shaft portion 9*a*, a second flange 9*c* at a rear portion of the shaft portion 9*a*, and a rear end portion 9*d* projecting rearward from the second flange 9*c* to act as an iron core for a later-described solenoid-operated actuator. The first flange 9*b* is restrained from turning by a retaining pin 12 fixedly fitted in the rear housing 2. The first flange 9*b* of the movable element 9 substantially axially separates the first storing region 32 from the second storing region 34. The first flange 9*b* has an inner end surface 9*e* axially facing the outer end surface 7*c* of the rotor element 7, and a disk-shaped gap is formed between the inner end surface 9*e* of the first flange 9*b* and the outer end surface 7*c* of the rotor element 7. Thus, the shearing action of the rotor element 7 is applied to the silicone oil 35 contained in the disk-shaped gap via the outer end surface 7*c* to generate heat. A coil spring 13, i.e., an elastic urging means for continuously applying an axially frontward force to the movable element 9, is interposed between the first flange 9*b* of the movable element 9 and the bearing 8. A casing 11 containing a solenoid 10 for applying a magnetically attractive force to the rear end portion 9*d* (the iron core) of the movable element 9 is attached to the outer face of the rear end wall of the rear housing 2.

The second flange 9*c* of the movable element 9 is provided to be able to move between the outer face of the rear end wall of the rear housing 2 and the solenoid 10. The solenoid 10 is connected to an external electronic control unit ECU which is not shown but arranged as a control unit for controlling a vehicle heating system. A thermo-sensing element for detecting temperature of the cooling water circulating through the heating system and a rotation-sensing element for detecting an engine speed of a vehicle engine are connected to the electronic control unit ECU. Thus, the viscous fluid type heat generating apparatus 100 is constructed.

A solenoid clutch 200 is mounted on the front housing 1 and the drive shaft 6. The solenoid clutch 200 has a pulley element 15 supported by a bearing 14 on the front housing 1 of the viscous fluid type heat generating apparatus 100, and a solenoid 16 built in the pulley element 15. The solenoid 16 is connected to the aforementioned electronic control unit ECU of the heating system. A hub element 19 is mounted on and fastened by a bolt 17 to the drive shaft 6 of the viscous fluid type heat generating apparatus 100 and is restrained from turning relative to the drive shaft by a key 18. An armature 21 of the solenoid clutch 200 is fixedly joined to the hub element 19 by an elastic ring 20, such as a rubber ring.

The viscous fluid type heat generating apparatus 100 is fixedly installed in a mounting space extending beside the vehicle engine, not shown, in parallel to the crankshaft of the vehicle engine. The pulley element 15 is driven for rotation, through a belt, by the vehicle engine.

When the drive shaft 6 of the viscous fluid type heat generating apparatus 100 thus constructed is driven through the solenoid clutch 200 by the vehicle engine, the rotor element 7 rotates in the heat generating chamber 3. Therefore, the silicone oil 35 is subjected to a shearing action in the annular gap between the inner circumference 3*a* of the heat generating chamber 3 and the cylindrical outer face 7*d* of the rotor element 7, and the disk-shaped gap between the inner end surface 93 of the movable element 9 and the outer end surface 7*c* of the rotor element 7 to generate heat. The heat thus generated is transmitted to the cooling water flowing through the heat receiving chamber 30 to heat the cooling water. The heated cooling water flows through the heating system to heat the passenger compartment and through the engine to heat the vehicle engine.

When the viscous fluid type heat generating apparatus 100 is thus driven by the vehicle engine, the silicone oil 35 contained in the first storing region 32 is forced to flow through the front end of the tubular portion 7*b* and the connecting hole 7*f* into the annular gap between the inner circumference 3*a* of the heat generating chamber 3 and the cylindrical outer face 7*d* of the rotor element 7 by a centrifugal force as shown in FIG. 1. Then, the silicone oil 35 flowing from the first storing region 32 into the annular gap presses a portion of the silicone oil 35 held in the annular gap. Accordingly, the pressed portion of the silicone oil 35 forcedly flows from the annular gap into the first storing region 32 via the front end portion of the tubular portion 7*b* and the connecting hole 7*e* of the rotor element 7. Further, since the silicone oil 35 is thermally expanded due to its own heat generation while being held within the annular gap and the flow of the silicone oil 35 from the annular gap into the first storing region 32 is promoted due to the thermal expansion of the silicone oil. Thus, the silicone oil 35 constantly circulates through the annular gap and the first storing region 32 to prevent only a particular portion of the silicone oil 35 from being held within the annular gap. Moreover, the first storing region 32 is provided so as to store a relatively large amount of silicone oil 35 therein, and accordingly, only a particular portion of the silicone oil 35 is subjected to a shearing action within the annular gap of the heat generating chamber 3. Thus, the degradation of the silicone oil due to the thermal and mechanical causes can be surely avoided.

In the viscous fluid type heat generating apparatus 100 of the present invention, even though the first storing region 32 stores the large amount of the silicone oil 35, an increase in a pressure prevailing in the heat generating chamber 3 can be suppressed, so that a leakage of the silicone oil 35 through the shaft seals of the bearings 5 and 8 can be prevented. Namely, in a first state where the temperature of the silicone oil 35 contained in the annular gap and the first storing region 32 is low and the solenoid 10 is not energized, the movable element 9 is urged axially frontward by the coil spring 13 and hence, the width of the disk-shaped gap between the inner end surface 9*e* of the movable element 9 and the outer end surface 7*c* of the rotor element 7 is reduced. The connecting hole 7*e* of the base portion 7*a* of the rotor element 7 is covered partly by the first flange 9*b* of the movable element 9 and the opening thereof is reduced, so that the flow of the silicone oil 35 between the first storing region 32 and the second storing region 34 is restricted to reduce the flow of the silicone oil 35 between the first storing region 32 and the second storing region 34. In the first state, the silicone oil 35 flows between the first storing region 32 and the annular gap provided between the inner circumference 3*a* of the heat generating chamber 3 and the cylindrical outer face 7*d* of the rotor element 7. Therefore, the first storing region 32 is directly affected by the thermal condition of the above-mentioned annular gap and a pressure in the heat generating chamber 3 gradually increases. Nevertheless, the temperature of the silicone oil 35 is still maintained low and leakage of the silicone oil 35 through the shaft seal of the bearing 5 does not occur.

In the first state, a theoretical heat generating rate Q can be expressed by the equation (1) below.

$$Q=(2\pi\mu R^3L/h_1)\omega^2+(\pi\mu R^4/2h_2)\omega^2 \quad (1)$$

where "$\mu$" is the viscosity of the silicone oil 35, "R" is the radius, "L" is the axial length of the tubular portion 7*b* of the rotor element 7, "h1" is the thickness of the annular gap between the inner circumference 3*a* of the heat generating chamber 3 and the cylindrical outer face 7*d* of the rotor element 7, "h2" is the thickness of the disk-shaped gap between the inner end surface 9*e* of the movable element 9 and the outer end surface 7*c* of the rotor element 7, and "ω" is the angular velocity of the rotor element 7. In this state, heat is generated at a high heat generating rate.

In a different second state where the silicone oil 35 contained in the gaps and the first storing region 32 is heated to have a high temperature by the continuous operation of the viscous fluid type heat generating apparatus 100, the movable element 9 is urged axially rearward against the resilience of the coil spring 13 by a pressure produced by the thermal expansion of the silicone oil 35 contained in the disk-shaped gap between the inner end surface 9*e* of the movable element 9 and the outer end surface 7*c* of the rotor element 7 and the thermal expansion of air in the heat generating chamber 3 as shown in FIG. 2, though the solenoid 10 is not energized. The maximum axial stroke of the movable element 9 is "L" between positions "A" and "B". Although a change in the thickness of the annular gap between the inner circumference 3*a* of the heat generating chamber 3 and the cylindrical outer face 7*d* of the rotor element 7 is very small, the amount of the disk-shaped gap between the inner end surface 9*e* of the movable element 9 and the outer end surface 7*c* of the rotor element 7 definitely increases. Accordingly, the first flange 9*b* of the movable element 9 is separated from the connecting hole 7*e* of the base portion 7*a* of the rotor element 7 and the opening of the connecting hole 7*e* increases. Then, the silicone oil 35 contained in the annular gap between the inner circumference 3*a* of the heat generating chamber 3 and the cylindrical outer face 7*d* of the rotor element 7 and the first storing region 32 can flow into the second storing region 34.

Therefore, in the second state, the amount of the silicone oil 35 contained in the first storing region 32 is reduced. Since the second storing region 34 is not directly affected by a thermal condition of the annular gap and the disk-shaped gap, the silicone oil 35 of a relatively high temperature flowing from the first storing region 32 into the second storing region 34 is not subjected to the shearing action and can be surely cooled. Therefore, only a relatively small amount of silicone oil 35 contained in the annular gap, the disk-shaped gap and the first storing region 32 of the heat generating chamber 3 exhibits thermal expansion, and the silicone oil 35 contained in the second storing region 34 exhibits contraction. Thus, a pressure increase in the heat generating chamber 3 is suppressed, and the leakage of the silicone oil 35 through the shaft seals of the bearings 5 and 8 does not occur. Accordingly, the viscous fluid type heat generating apparatus 100 can achieve both reliable prevention of degradation in the heat generating performance of the silicone oil 35 and reliable prevention of leakage of the silicone oil 35.

Further, when the silicone oil 35 employed in the viscous fluid type heat generating apparatus 100 is of a high viscosity to increase the maximum amount of heat per predetermined number of rotation of the drive shaft 6, the silicon oil 35 can easily flow between the gap and the first storing region 32, and the second storing region 34. Thus, the reliable prevention of degradation in the heat generating performance of the silicone oil 35 and the reliable prevention of leakage of the silicone oil 35 can be achieved irrespective of the high viscosity of the silicone oil 35.

The theoretical heat generating rate Q in the second state can be expressed by the equation (2) below.

$$Q=(2\pi\mu R^3L/h_1)\omega^2 \quad (2)$$

In the second state, heat is generated at a low heat generating rate. Accordingly, the viscous fluid type heat generating apparatus 100 can achieve both reliable prevention of degradation in the heat-generating performance of the silicone oil 35 and reliable prevention of leakage of the silicone oil 35.

Since the movable element 9 of the viscous fluid type heat generating apparatus 100 can be moved by the solenoid 10, the silicone oil 35 can be forced to flow through the connecting hole 7*e* of the rotor element 7 by controlling the solenoid 10 for repetitive on and off motions by the external controller even if the silicone oil 35 has a high viscosity to exhibit a low flowability.

If the solenoid 10 is energized to pull the rear end portion 9*d* of the movable element 9 toward the solenoid 10 so as to shift the movable element 9 axially by the distance "L" from the position "A" to the position "B" when starting the vehicle, the amount of the disk-shaped gap between the inner end surface 9*e* of the movable element 9 and the outer end surface 7*c* of the rotor element 7 increases, the torque acting on the drive shaft 6 is reduced and, hence, the vehicle can be smoothly accelerated. The electronic control unit ECU can suppress the generation of heat in the silicone oil 35 more delicately on the basis of the temperature of the cooling water flowing in the heating circuit and engine speed.

The solenoid clutch 200 of the viscous fluid type heat generating apparatus 100 in the first embodiment may be omitted, and the viscous fluid type heat generating apparatus 100 may be driven by an external drive source (e.g., a vehicle engine) via only a pulley element attached to the drive shaft 6.

Second Embodiment

Figure 3:
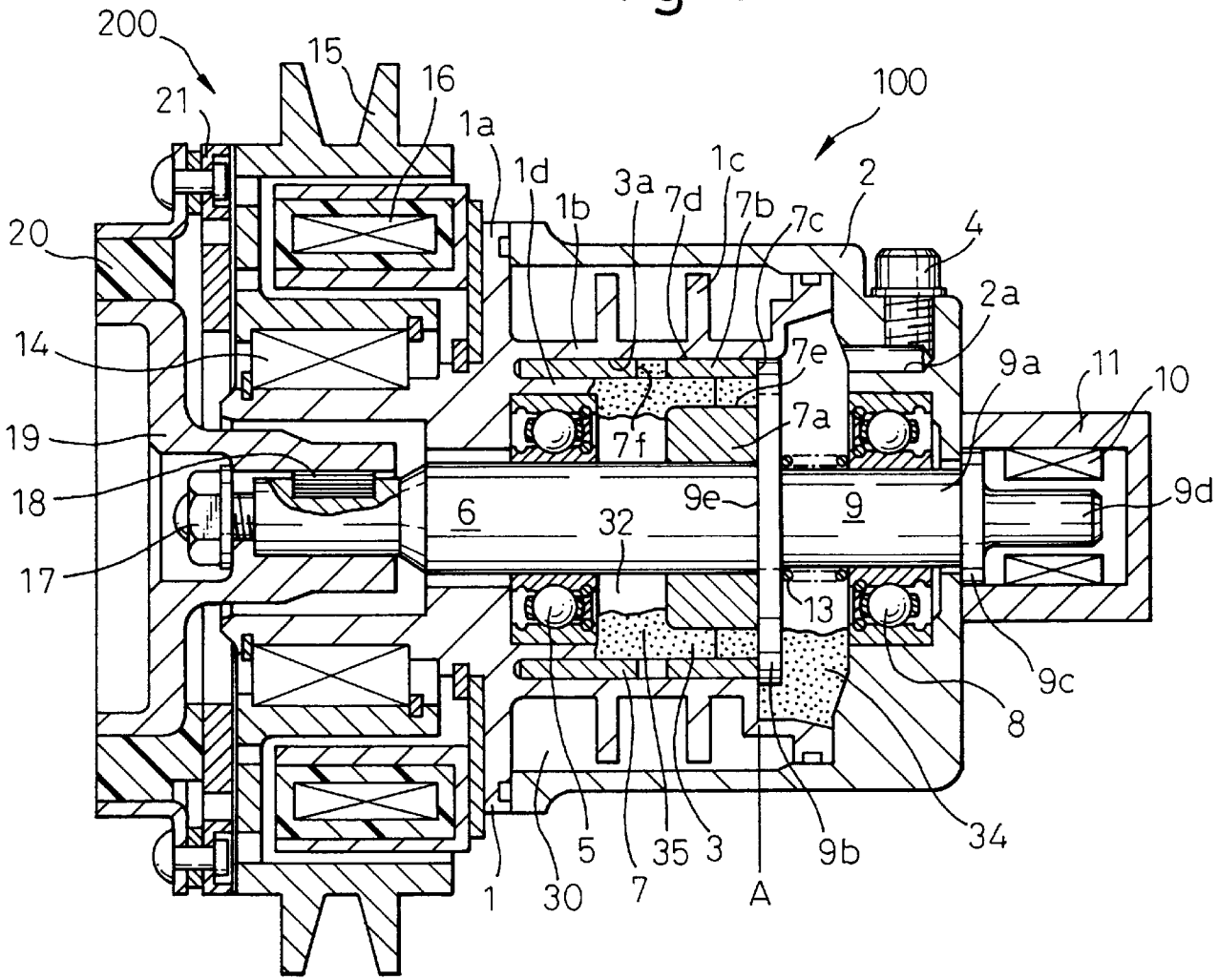
FIG. 3 is a longitudinal sectional view of a viscous fluid type heat generating apparatus according to a second embodiment of the present invention in a state before a movable element is shifted.
Figure 4:
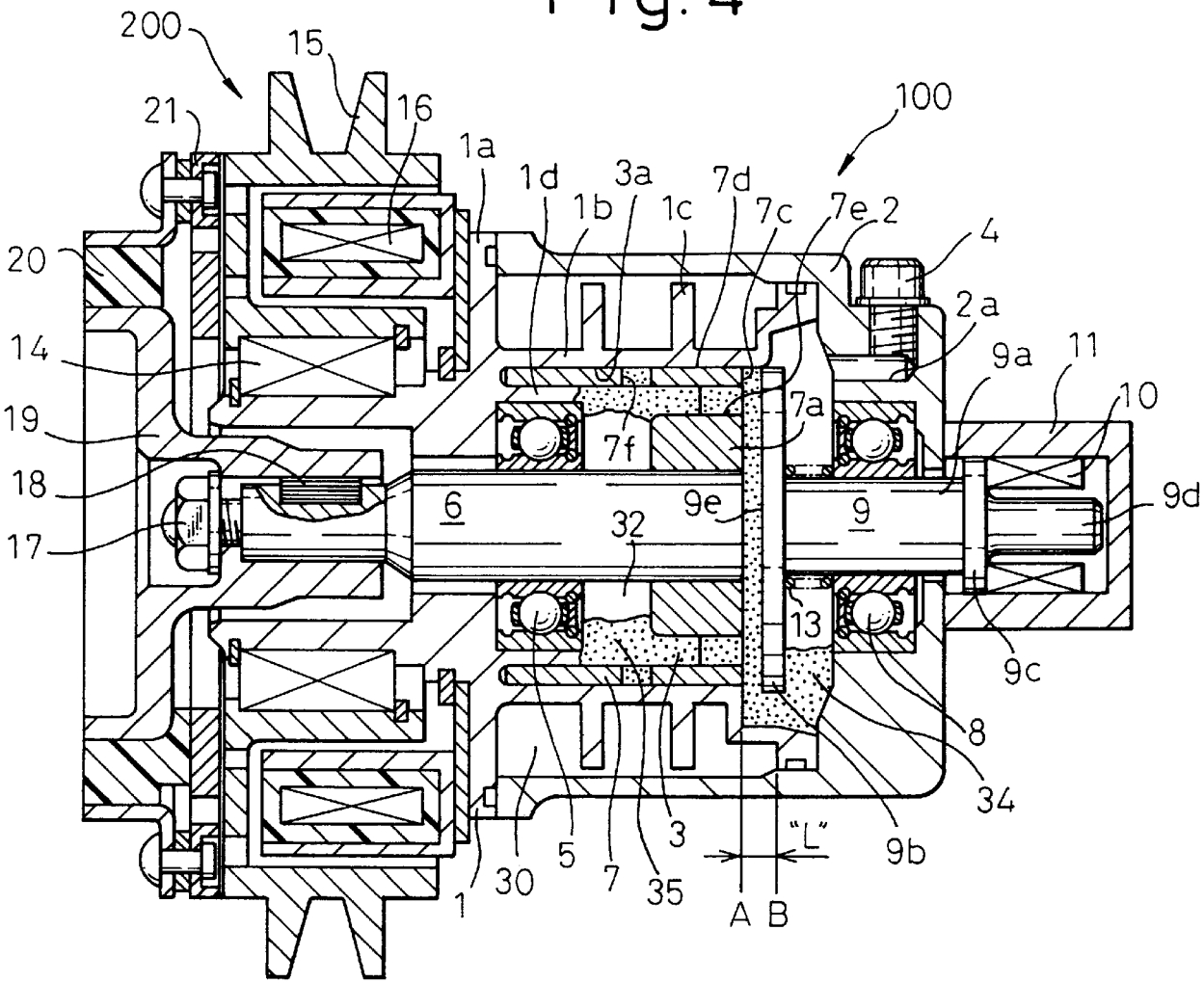
FIG. 4 is a longitudinal sectional view of the viscous fluid type heat generating apparatus of the second embodiment in a state after the movable element has been shifted.

Referring to FIGS. 3 and 4, a viscous fluid type heat generating apparatus 100 according to a second embodiment of the present invention is provided with no member corresponding to the retaining pin 12, so that a movable element 9 is permitted to rotate relative to a rotor element 7 by drag torque during the rotation of the rotor element 7.

It should be understood that the construction of the viscous fluid type heat generating apparatus 100 according to the second embodiment is the same in other respects as the viscous fluid type heat generating apparatus 100 according to the first embodiment.

When the viscous fluid type heat generating apparatus 100 continues operation, the movable element 9 rotates at an angular velocity slightly lower than that of the rotor element 7. The theoretical heat generating rate Q in this state is expressed by the equation (3) below.

$$Q=(2\pi\mu R^3L/h_1)\omega^2+(\pi\mu R^4/2h_2)(\omega_1-\omega_2)^2 \quad (3)$$

The viscous fluid type heating apparatus 100 generates heat at a high heat generating rate if the difference between the respective rotating speeds of the movable element 9 and the rotor element 7 is large, and at a low heat generating rate if the difference between the respective rotating speeds of the movable element 9 and the rotor element 7 is small. The rest of operations and advantageous effects of the viscous fluid type heating apparatus 100 according to the second embodiment are similar to those of the viscous fluid type heat generating apparatus 100 according to the first embodiment.

It should be understood that many modifications will occur to a person skilled in the art without departing from the scope and spirit of the present invention as claimed in the accompanying claims.

What we claim:

1. A viscous fluid type heat generating apparatus comprising:

a housing internally defining a heat generating chamber enclosed by a wall surface thereof, and a heat receiving chamber arranged adjacent to said heat generating chamber and permitting a heat exchanging fluid to flow therethrough;

a drive shaft rotatably supported by a bearing means and a shaft sealing means housed in said housing;

a rotor element arranged in said heat generating chamber to be driven for rotation about an axis thereof by said drive shaft and having an outer face; and a viscous fluid held in a fluid-holding gap defined between said wall surface of said heat generating chamber and said outer face of said rotor element to generate heat in response to an application of a shearing action thereto by said rotor element;

wherein said heat generating chamber defines, in addition to said fluid-holding gap, a storing chamber for storing the viscous fluid to avoid application of the shearing action from said rotor element to the viscous fluid, said storing chamber including a first storing region arranged to be directly affected by a thermal condition of said fluid-holding gap and allowing the viscous fluid to flow between said fluid-holding gap and said first storing region, and a second storing region substantially separated from said first storing region and arranged to be not directly affected by the thermal condition of said fluid-holding gap; and wherein the viscous fluid type heat generating apparatus further comprises means for adjusting the flow of the viscous fluid between said first and second storing regions of said storing chamber.

2. The viscous fluid type heat generating apparatus according to claim 1, wherein said rotor element has a base portion mounted on said drive shaft, and a tubular portion extending from said base portion to have an outer cylindrical face constituting a main part of said outer face of said rotor element, said outer cylindrical face cooperating with said wall surface of said heat generating chamber to define said fluid-holding gap, wherein said first storing region of said storing chamber is arranged inside said tubular portion of said rotor element so as to have an opening formed in said outer cylindrical face of said tubular portion of said rotor element, wherein said second storing region of said storing chamber is arranged outside said tubular portion of said rotor element, and wherein said means for adjusting the flow of the viscous fluid between said first and second storing regions comprises a movable element arranged to be adjustably moved between said first and second storing regions.

3. The viscous fluid type heat generating apparatus according to claim 2, wherein said tubular portion of said rotor element extends from said base portion substantially axially in parallel with the axis of rotation of said rotor element.

4. The viscous fluid type heat generating apparatus according to claim 2, wherein said tubular portion of said rotor element extends from said base portion at a given inclination to said axis of rotation of said rotor element.

5. The viscous fluid type heat generating apparatus according to claim 2, wherein said rotor element further has an outer end surface extending radially with respect to said axis of rotation thereof and forming a part of said outer face thereof, and wherein said movable element has an end surface portion extending radially to confront said outer end surface of said rotor element, said end surface portion of said movable element and said outer end surface of said rotor element defining therebetween a disk-shaped gap capable of holding therein the viscous fluid when said movable element is moved to a position adjacent to said rotor element, said disk-shaped gap being a part of said fluid-holding gap.

6. The viscous fluid type heat generating apparatus according to claim 5, wherein said end surface portion of said movable element and said outer end surface of said rotor element increase said disk-like gap when said movable element is moved away from the position adjacent to said rotor element.

7. The viscous fluid type heat generating apparatus according to claim 5, wherein said base portion of said rotor element is provided with said outer end surface as a part thereof, and said tubular portion and said base portion of said rotor element are provided with connecting holes formed so as to extend therethrough to thereby permit the viscous fluid to pass therethrough.

8. The viscous fluid type heat generating apparatus according to claim 2, wherein said movable element is arranged to be movable in response to a thermal expansion of the viscous fluid in said heat generating chamber.

9. The viscous fluid type heat generating apparatus according to claim 8, wherein said movable element is arranged to be moved in a direction away from said rotor element in response to said thermal expansion of the viscous fluid in said heat generating chamber.

10. The viscous fluid type heat generating apparatus according to claim 2, wherein said viscous fluid type heat generating apparatus further comprises a solenoid capable of actuating the movement of said movable element toward and away from said rotor element.

11. The viscous fluid type heat generating apparatus according to claim 2, wherein said movable element is supported for rotation so that the rotation of said movable element relative to said rotor element is variable.

12. The viscous fluid type heat generating apparatus according to claim 5, wherein said movable element is axially and constantly urged toward said outer end surface of said rotor element by an urging means.

13. The viscous fluid type heat generating apparatus according to claim 12, wherein said urging means comprises a compression spring element.

* * * * *